US008746154B2

(12) United States Patent
Schoerkhuber et al.

(10) Patent No.: US 8,746,154 B2
(45) Date of Patent: Jun. 10, 2014

(54) CONCEALED 180° HINGE

(75) Inventors: Jakob Schoerkhuber, Altenhof (AT); Bernhard Kammerer, Zell an der Pram (AT)

(73) Assignee: FACC AG, Ried Im Innkreis (AT)

( * ) Notice: Subject to any disclaimer, the term of this patent is extended or adjusted under 35 U.S.C. 154(b) by 61 days.

(21) Appl. No.: 13/510,345

(22) PCT Filed: Nov. 25, 2010

(86) PCT No.: PCT/AT2010/000462

§ 371 (c)(1),
(2), (4) Date: May 17, 2012

(87) PCT Pub. No.: WO2011/063441

PCT Pub. Date: Jun. 3, 2011

(65) Prior Publication Data

US 2012/0325123 A1 Dec. 27, 2012

(30) Foreign Application Priority Data

Nov. 25, 2009 (AT) ..... A 1872/2009

(51) Int. Cl.
*A47B 1/04* (2006.01)

(52) U.S. Cl.
USPC ..... 108/77

(58) Field of Classification Search
USPC ..... 16/277, 302, 366, 367, 371, 370; 108/77–82, 166, 167, 171
See application file for complete search history.

(56) References Cited

U.S. PATENT DOCUMENTS

| | | | | | |
|---|---|---|---|---|---|
| 495,268 | A * | 4/1893 | Reichardt | 16/370 |
| 712,797 | A * | 11/1902 | Holtzman | 16/370 |
| 862,550 | A * | 8/1907 | Gardner | 16/370 |
| 1,382,654 | A * | 6/1921 | Korb | 16/370 |
| 1,735,696 | A * | 11/1929 | Ridley | 16/371 |
| 2,206,708 | A * | 7/1940 | Stumpf | 16/358 |
| 2,570,479 | A | 10/1951 | Pollman | |
| 2,777,155 | A * | 1/1957 | Fata | 16/357 |
| 2,901,766 | A | 9/1959 | Marquis | |
| 2,968,829 | A * | 1/1961 | Meddick | 16/273 |
| 4,928,350 | A * | 5/1990 | Morgan | 16/297 |
| 5,148,850 | A * | 9/1992 | Urbanick | 160/231.1 |
| 7,866,368 | B2 * | 1/2011 | Ostrovsky et al. | 160/201 |
| 2009/0106940 | A1 * | 4/2009 | Greenbank | 16/367 |

FOREIGN PATENT DOCUMENTS

| | | |
|---|---|---|
| DE | 30 44 159 A1 | 6/1982 |
| DE | 3044159 A1 | 6/1982 |
| DE | 203 03 262 U1 | 4/2004 |
| DE | 10 2004 029 831 B3 | 1/2006 |
| EP | 0 013 999 A1 | 8/1980 |

* cited by examiner

*Primary Examiner* — Matthew Ing
(74) *Attorney, Agent, or Firm* — Laurence A. Greenberg; Werner H. Stemer; Ralph E. Locher

(57) ABSTRACT

A concealed 180° hinge for the movable connection of two parts between a collapsed state and a fully opened-out state of the parts has at least two U-shaped pivoting brackets. The hinge, which has the highest possible strength and also allows the two parts to be moved in relation to one another without any risk of collision, includes rotary pins of the two pivoting brackets on the one hinge part that are arranged in a plane substantially parallel to the plane of the part, which can be connected to this one hinge part. The rotary pins of the two pivoting brackets on the second hinge part are disposed in a plane located substantially perpendicularly to the plane of the part, which can be connected to this second hinge part.

16 Claims, 8 Drawing Sheets

CONCEALED 180° HINGE

BACKGROUND OF THE INVENTION

Field of the Invention

The invention relates to a concealed 180° hinge for the movable connection of two parts between a collapsed state, in which the parts are arranged on top of each other, and a fully opened-out state, in which the parts are aligned evenly next to each other, the hinge having two hinge parts for attachment to the parts to be connected, a U-shaped pivoting bracket and at least a second U-shaped pivoting bracket, each of which is pivotably connected to a hinge part at the ends of the U-shaped arms of the brackets, with the pivot axes of the second pivoting bracket being arranged offset from the pivot axes of the first pivoting bracket.

The present hinge may be used in different ways, for example for opening out a table, which may be installed in an aeroplane. Here, the hinge should not be visible, at least not in the opened-out state of the movably connected parts, so that in case of a table, for example, the surface of the opened-out table is not interrupted by the hinge and only a small gap remains between the connected parts.

In hinges of this type, a distinction is made between continuous hinges, in which the movements of the parts to be connected are coupled, and discontinuous hinges, in which the pivoting movements of the parts to be connected are independent from each other. A drawback of continuous hinges is that the system usually is very weak, i.e. it comprises a low rigidity and strength. Moreover, a relatively wide gap exists between the parts to be connected in the opened-out state because otherwise the parts to be connected would collide during movements.

In the discontinuous or unguided hinges, on the other hand, a collision of the parts during movements may result from the independent pivoting movements of the parts to be connected, which could lead to damage on the parts, in particular on the edges of the parts to be connected.

DE 30 23 637 A1 describes a hinge for a door or a window with an opening angle of 180°, corresponding to the discontinuous hinge mentioned above.

U.S. Pat. No. 4,928,350 A describes another hinge, in which a guiding is somewhat simulated by a spring. Such hinge exhibits the drawbacks mentioned above as well.

U.S. Pat. No. 7,203,997 B2 describes a hinge with a linear guiding, carrying out a vaguely defined movement due to the necessary tolerances. Moreover, a linear guiding requires very complex geometries and excessive wear may occur.

U.S. Pat. No. 1,382,754 A shows a hinge for the connection of two parts, wherein a surface of the connected parts is interrupted by the mounting plates of the hinge parts in the opened-out state of the parts.

DE 10 2006 034 496 B3, U.S. Pat. No. 2,570,479 A and U.S. Pat. No. 5,410,779 A show further hinges not suitable for use as a movable connection of two parts between a collapsed state and an opened-out state.

BRIEF SUMMARY OF THE INVENTION

The object of the present invention is to create a hinge as mentioned above to combine the advantages of continuous hinges and discontinuous hinges, i.e. to ensure dependent pivoting movements of the parts to be connected and/or a forced guiding as well as to guarantee the required rigidity and strength. Drawbacks of known hinges should be avoided or at least reduced.

The object according to the invention is achieved by a hinge as mentioned above, in which the pivot axes of the two pivoting brackets on the one hinge part are arranged in a plane located substantially parallel to the plane of the part which can be connected to this hinge part, and the pivot axes of the two pivoting brackets on the second hinge part are arranged in a plane located substantially perpendicularly to the plane of the part which can be connected to this hinge part. By using at least two pivoting brackets with different pivot axes, the functions of the hinge are separated, i.e. the transmission of forces on the one hand and the forced guiding on the other hand. Due to the offset arrangement of the pivot axes of the at least two pivoting brackets, the parts to be connected may not be pivoted arbitrarily during movement, but are constrained by a forced guiding. Thereby, contact of the parts during movement may be predetermined accurately, so that the gap resulting in the opened-out state of the two parts may be minimised. When using the hinge in a board of a folding table, it is particularly important for the gap to be as small as possible in order to achieve a uniform surface for the table. Furthermore, the at least one additional pivoting bracket enables an ideal transmission of static forces to enhance rigidity and strength of the system. The construction, in which the plane created by the pivot axes of the one part is located substantially parallel to this part and the plane created by the pivot axes on the second part is located substantially perpendicularly to this part, leads to an ideal implementation of the desired 180° movement of the parts to be connected in relation to each other.

Seen in the direction of the pivot axes, the at least two pivoting brackets are advantageously arranged one after the other. This results in a relatively simple design, which is characterised merely by a slightly larger construction than in conventional hinges.

Preferably, the parts of the hinge provide recesses for the arrangement of the arms of the pivoting brackets, and in order to form the pivot axes, two bores are arranged within each of the hinge parts and one bore is arranged within each of the pivoting brackets, with a pin being arrangeable through each of these bores. The merit of this type of construction of a 180° hinge is its simplicity and its stability.

Advantageously, at least one stopper or the like is arranged on one hinge part and at least one outline matching this stopper or the like is arranged on the other hinge part, with the at least one stopper or the like protruding into the at least one outline of the other hinge part when the hinge is fully opened out. This improves alignment when the hinge is opened out, so the surfaces of the parts to be connected fall exactly in line with each other.

According to another feature of the invention, at least one intermediate member for connection with a hinge part is provided, which intermediate member may be connected to one part to be connected. In this way, the hinge parts are attached to the parts to be connected, such as the table boards, via the intermediate member.

The intermediate member may be glued to the part to be connected, for example. This type of connection is especially suitable for a movable connection of sandwich members with honeycomb cores, in which screws or the like cannot be applied securely.

The hinge parts may also be formed as multiple parts that are connected to each other. This makes it possible to create hinges of a modular design, in which case at least one further pivoting bracket might only be provided when necessary, for example. Another possibility is to equip only one part of an arrangement of several hinges with the at least two pivoting brackets according to the invention.

Advantageously, a pivoting bracket for absorbing forces is formed more stable than the other pivoting bracket for forced guiding.

For increasing strength, at least one further pivoting bracket may be provided for absorbing the forces during movement of the parts to be connected. The pivot axes of this at least one further pivoting bracket correspond to the pivot axes of the one pivoting bracket for absorbing forces.

For supporting the movement of the hinge parts, at least one spring element may be provided. This spring element may be designed in different ways, for example as a torsional spring.

The hinge parts and the pivoting brackets are preferably made of steel, aluminium or plastic, and the possible at least one intermediate member is preferably made of aluminium or plastic.

The present invention will be discussed in more detail by means of the attached drawings.

In the drawings:

DESCRIPTION OF THE INVENTION

Figure 1A:
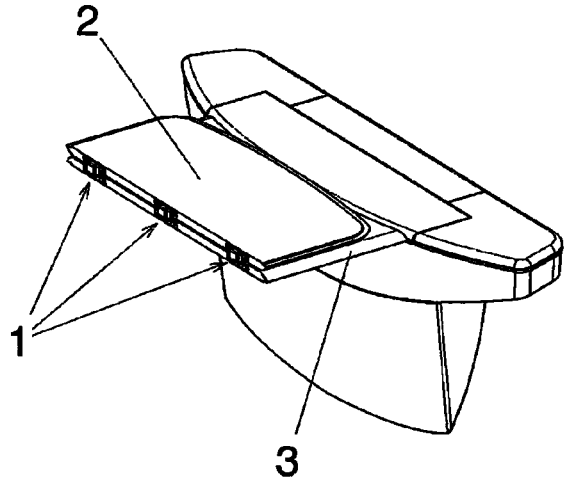
FIGS. 1*a* to 1*c* show the basic use of 180° hinges in a folding table, for example in an aeroplane.
Figure 1B:
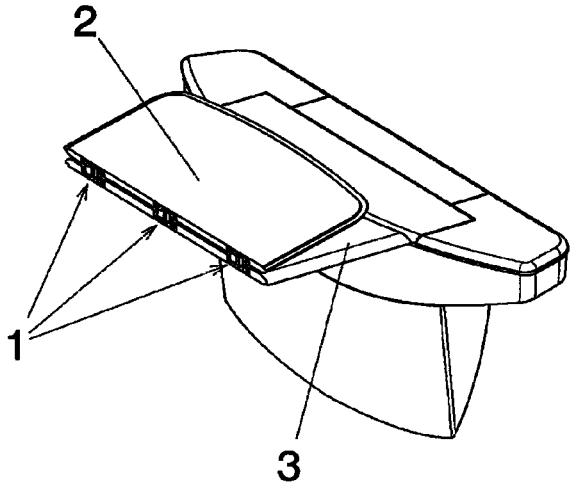
Figure 1C:
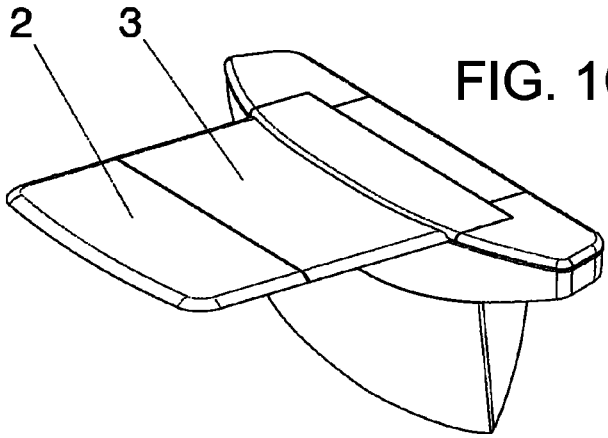

FIGS. 1*a* to 1*c* show a folding table as it may be used in an aeroplane with limited space, for example. Substantially, the table is comprised of two parts 2, 3, of which one part 2 is connected to the fixed part 3 via hinges 1, so said movable part 2 may be opened out by 180° in relation to the fixed part 3. In the collapsed state according to FIG. 1*a*, three hinges 1 are visible. In the opened-out state of the table according to FIG. 1*c*, the concealed hinges 1 are not visible. When using the 180° hinges for opening out the parts 2, 3 of a table, the gap between the parts 2, 3 of the table in the opened-out state according to FIG. 1*c* should be as small as possible to provide a table surface as uniform as possible.

FIGS. 2*a* to 2*e* show an embodiment of a 180° hinge 1 according to the invention comprising two hinge parts 4, 5 that are movably connected to each other by two pivoting brackets 6, 7. The pivoting brackets 6, 7 are substantially formed to be U-shaped, with each being pivotably connected to a hinge part 4, 5 at the ends of the U-shaped arms of the brackets. According to the invention, the pivot axes A and B of the pivoting bracket 6 and the pivot axes C and D of the pivoting bracket 7 are arranged in an offset fashion, as can be seen in FIG. 2*d* and FIGS. 3*a* to 3*e*. For forming the pivot axes A, B, C and D, corresponding bores are arranged within the hinge parts 4, 5 and the pivoting brackets 6, 7, with a pin being arrangeable through each of these bores.

In the embodiment according to FIGS. 2*a* to 2*e*, two intermediate members 8, 9 are provided, each of which may be connected to a hinge part 4, 5 and, in turn, to the parts 2, 3 to be connected (not shown). The intermediate members 8, 9 may have identical design. The intermediate members 8, 9 may be connected to the hinge parts 4, 5 by screws, for example. The intermediate members 8, 9 may be glued to the parts 2, 3 to be connected, for example, which is especially useful for parts made of sandwich composite materials, since screw connections cannot be used in this case. The intermediate members 8, 9 may be made of aluminium or plastic, for example, while the hinge parts 4, 5, the pivoting brackets 6, 7 and their respective pins may be manufactured from steel, aluminium or plastic.

Figure 2A:
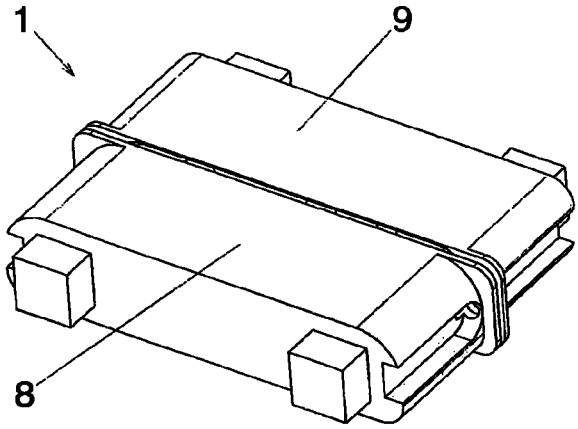
FIGS. 2*a* to 2*e* show different perspective views of an embodiment of a hinge according to the invention.
Figure 2B:
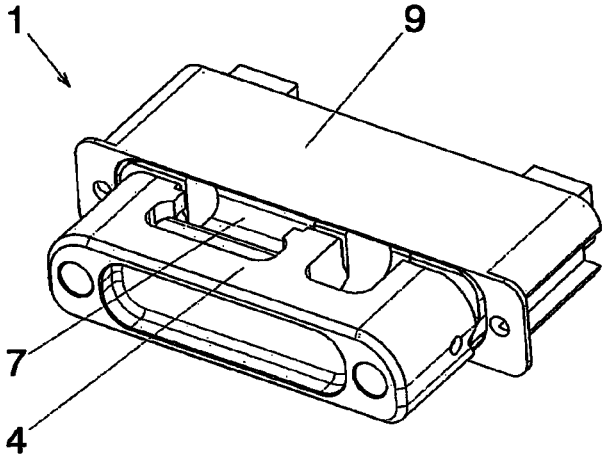
Figure 2C:
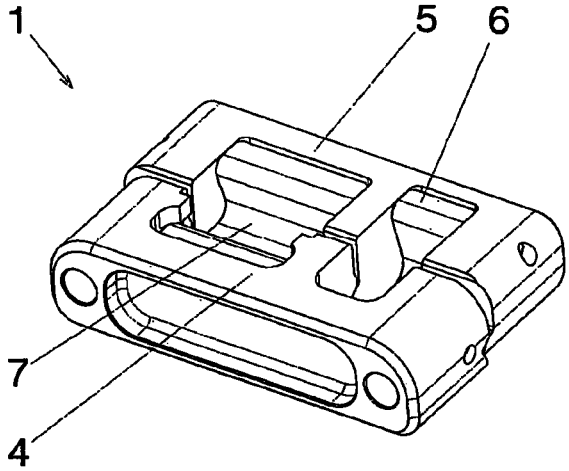
Figure 2D:
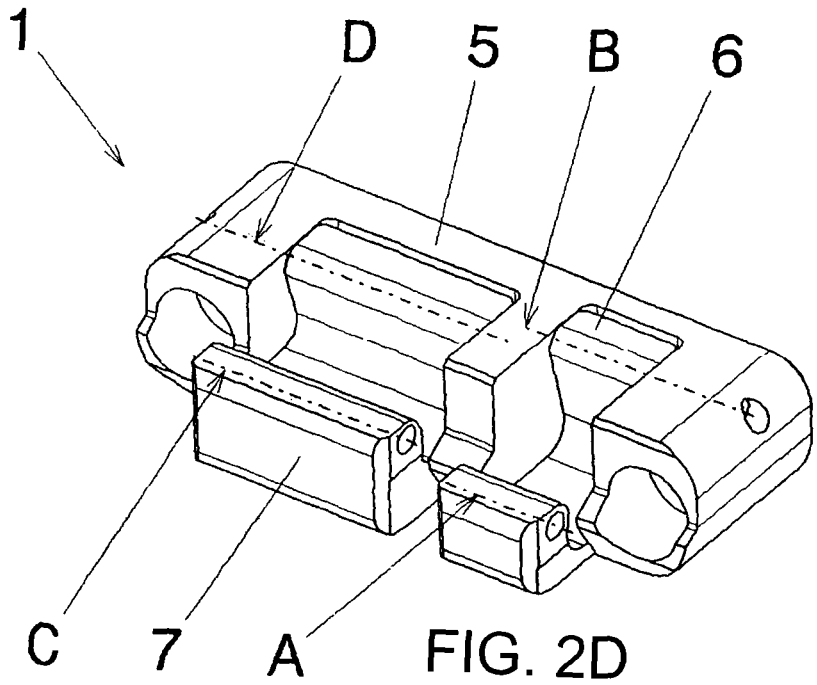
Figure 2E:
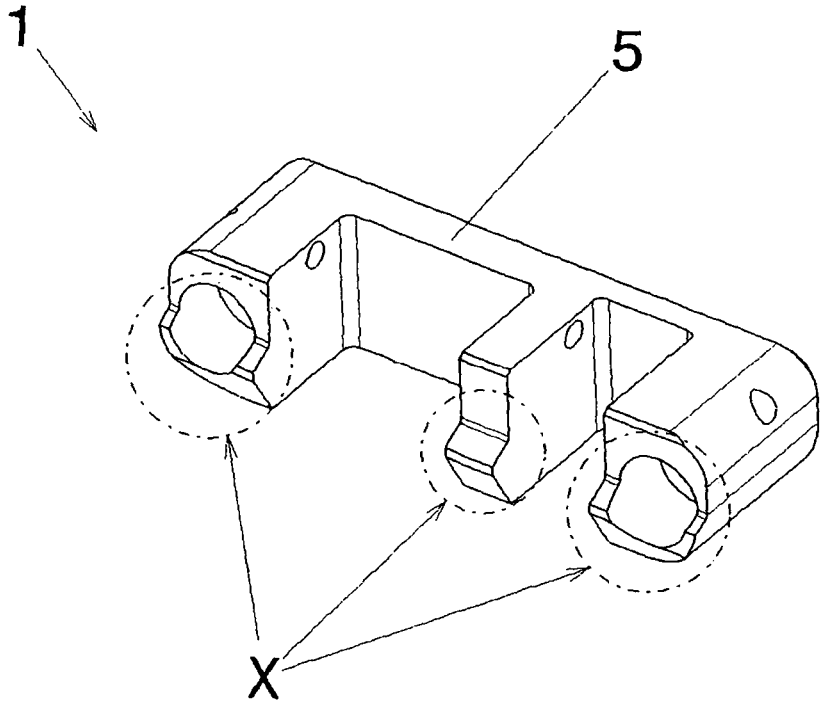

As can best be seen in FIG. 2*e*, three stoppers X or the like are arranged on the hinge part 5, and matching outlines are arranged on the other hinge part 4, with the stoppers X or the like protruding into the outlines when the hinge 1 is in the fully opened-out state. This improves the alignment of the parts 2, 3 to be connected.

The profile of the movements of the parts 2, 3, which are connected to the hinge 1 according to the invention, will be understood more clearly referring to FIGS. 3*a* to 3*e*. In the state according to FIG. 3*a*, the parts 2, 3 to be connected are located on top of each other at a distance d1, which is as small as possible. According to the invention, the two pivoting brackets 6, 7 are arranged in such a way that the pivot axes A, B of the pivoting bracket 6 and the pivot axes C, D of the pivoting bracket 7 are arranged in an offset fashion. This offset arrangement of the pivot axes A, C and B, D results in a forced guiding of part 2, which is moved in relation to part 3. In the exemplary embodiment shown, the pivot axes A, C of the two pivoting brackets 6, 7 on the second hinge part 4 are arranged in a plane located substantially perpendicularly to the plane of part 2 connected to this hinge part 4, while the two pivot axes B, D of the two pivoting brackets 6, 7 on hinge part 5 are arranged in a plane located substantially parallel to the plane of part 3 connected to this hinge part 5. In the course of the movement of part 2 in relation to the fixed part 3, part 2 completes a 180° movement, so that parts 2, 3 are now arranged next to each other according to FIG. 3*e*, spaced apart by a gap d2. Due to the forced guiding of part 2 in relation to part 3 by the hinge 1 according to the invention, both gap d1 (see FIG. 3*a*) and gap d2 (FIG. 3*e*) can be kept small without risking a collision of parts 2, 3 during the movement of part 2 in relation to part 3.

Figure 3A:
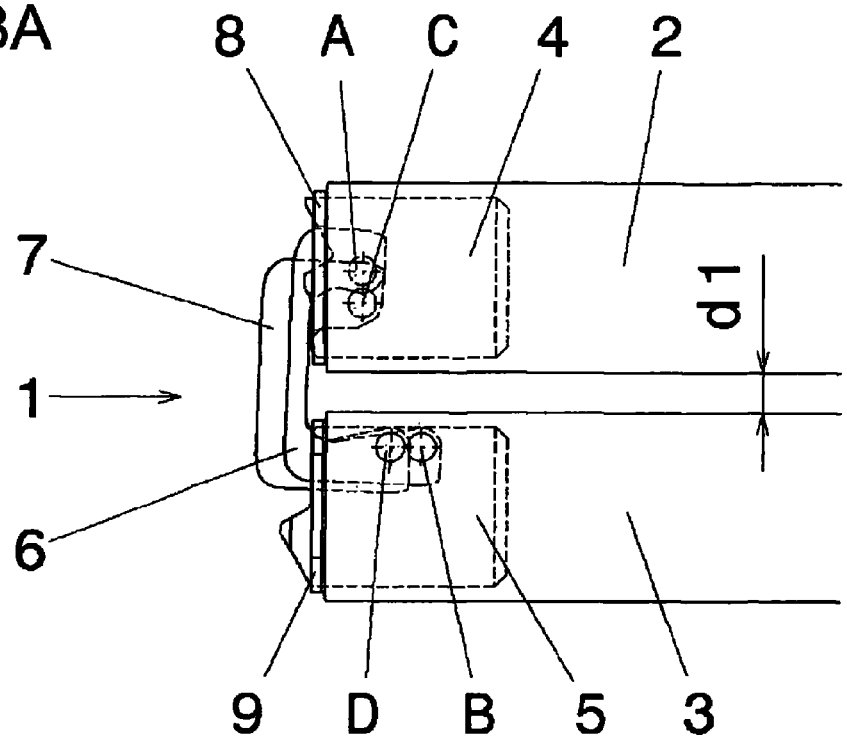
FIGS. 3*a* to 3*e* show side views of a hinge according to FIGS. 2*a* to 2*e*, partially in section, during a complete movement of the parts to be connected.
Figure 3B:
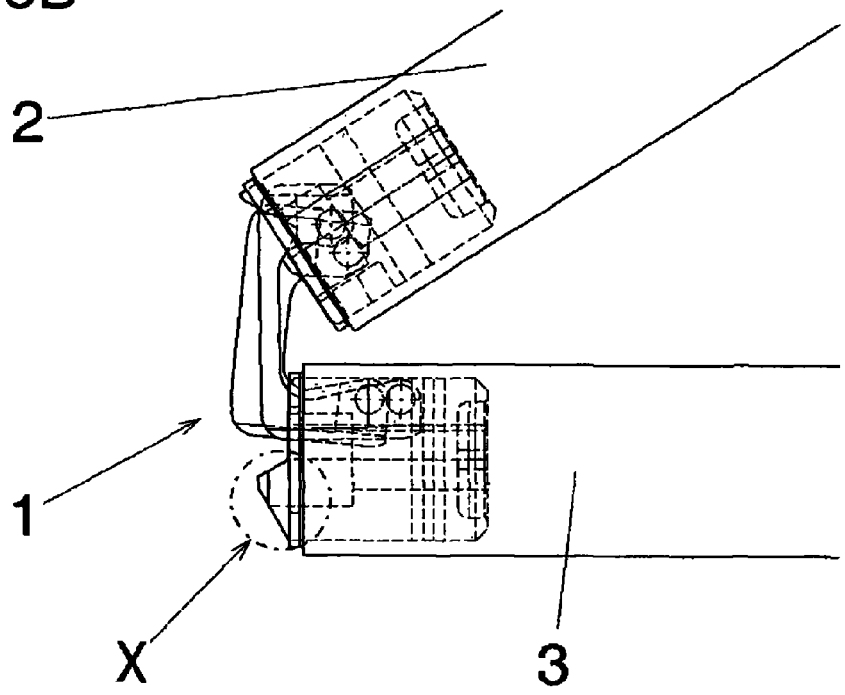
Figure 3C:
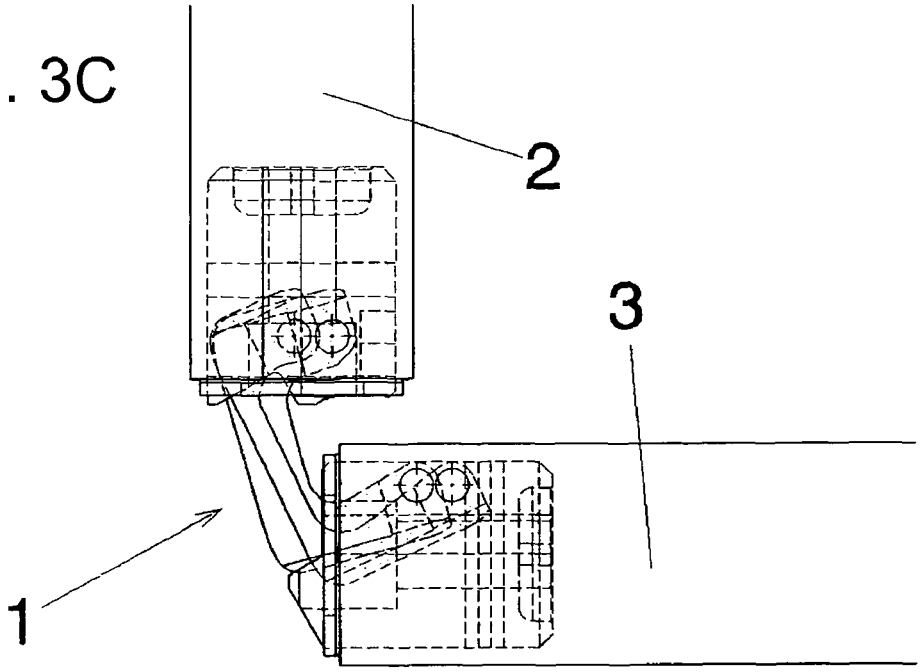
Figure 3D:
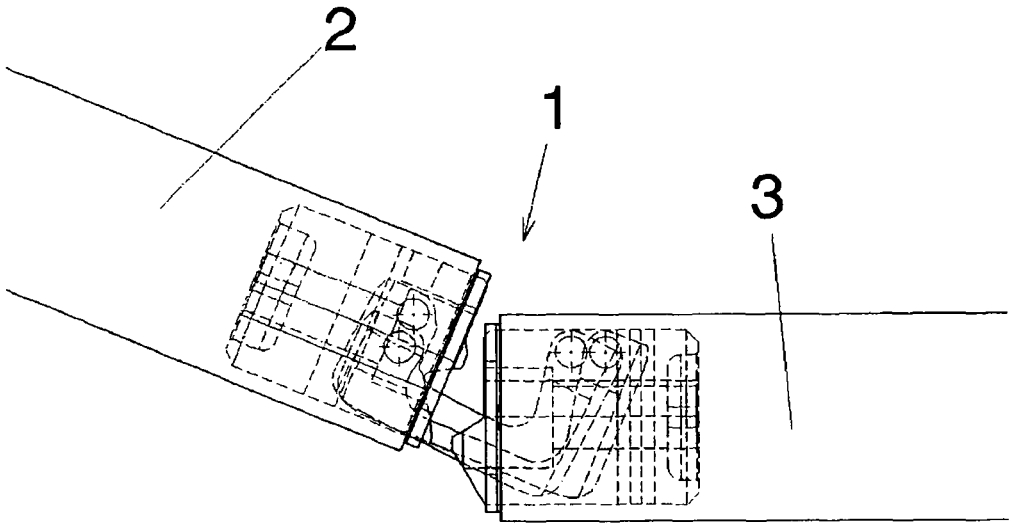
Figure 3E:
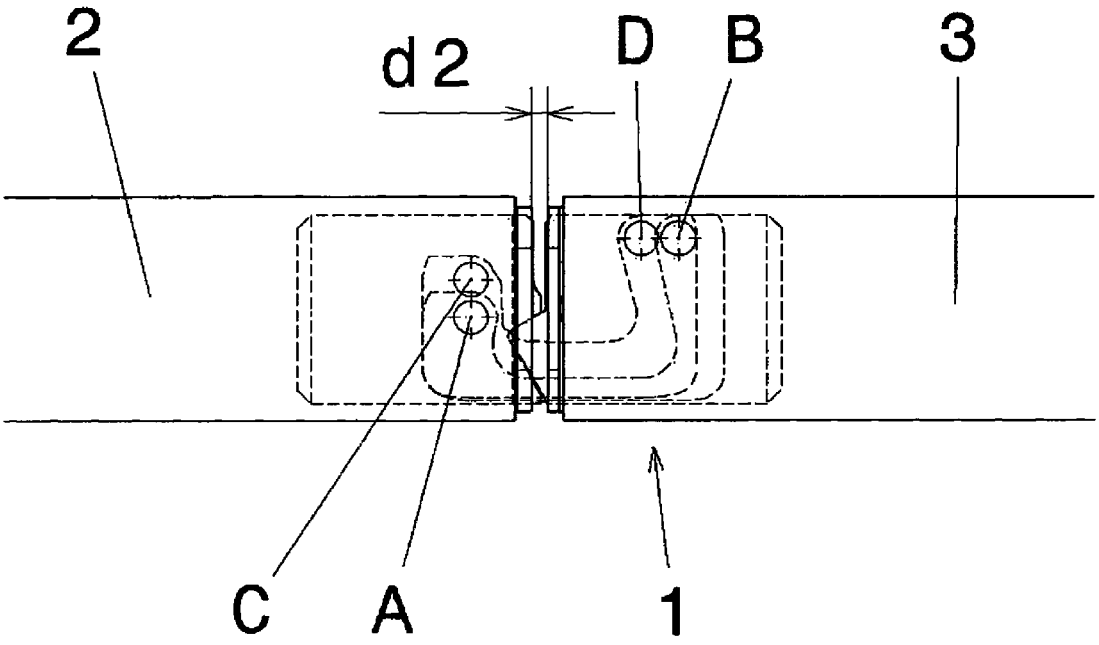
Figure 4A:
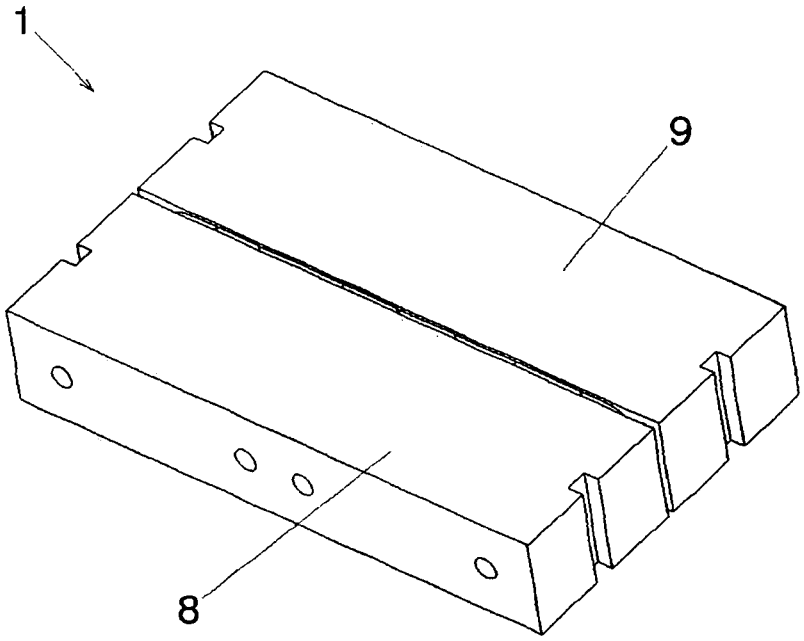
FIGS. 4*a* to 4*d* show an embodiment of a hinge according to the invention that is different than that of FIGS. 2*a* to 2*e*.
Figure 4B:
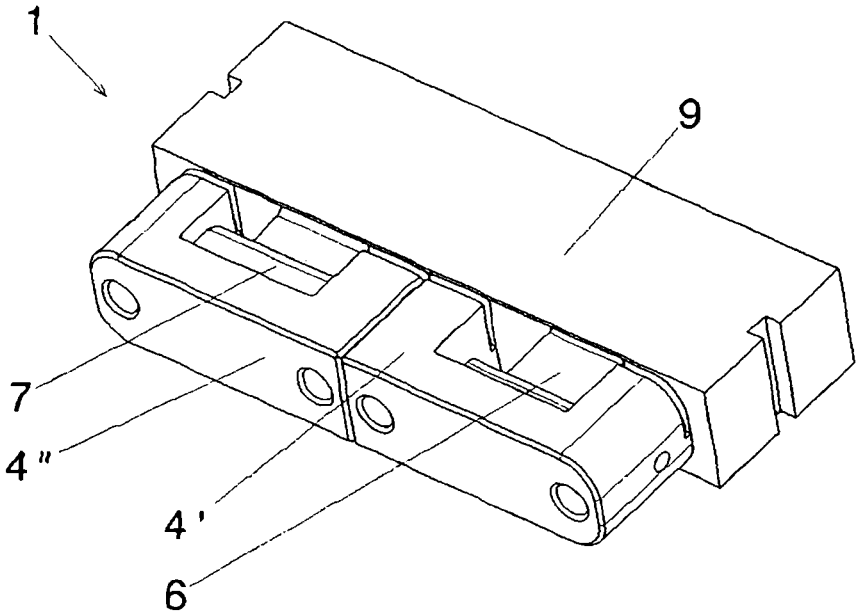
Figure 4C:
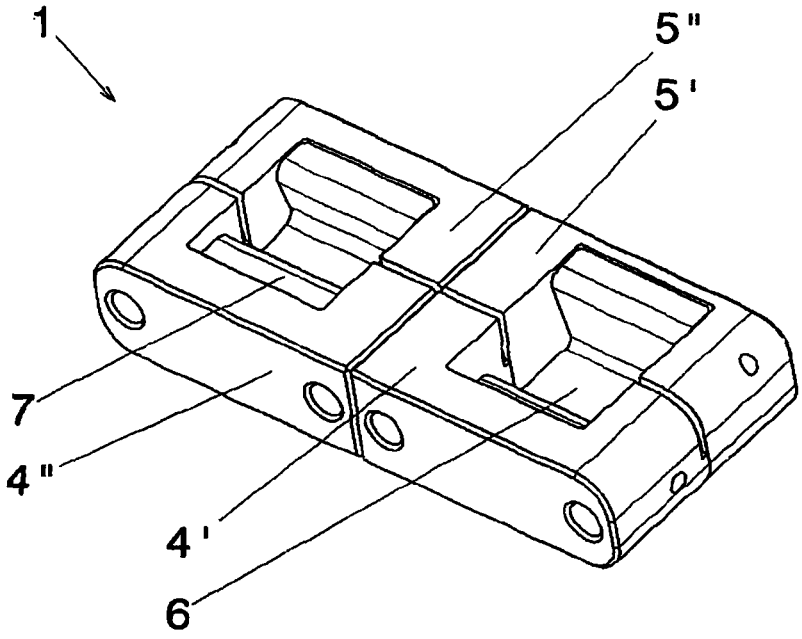
Figure 4D:
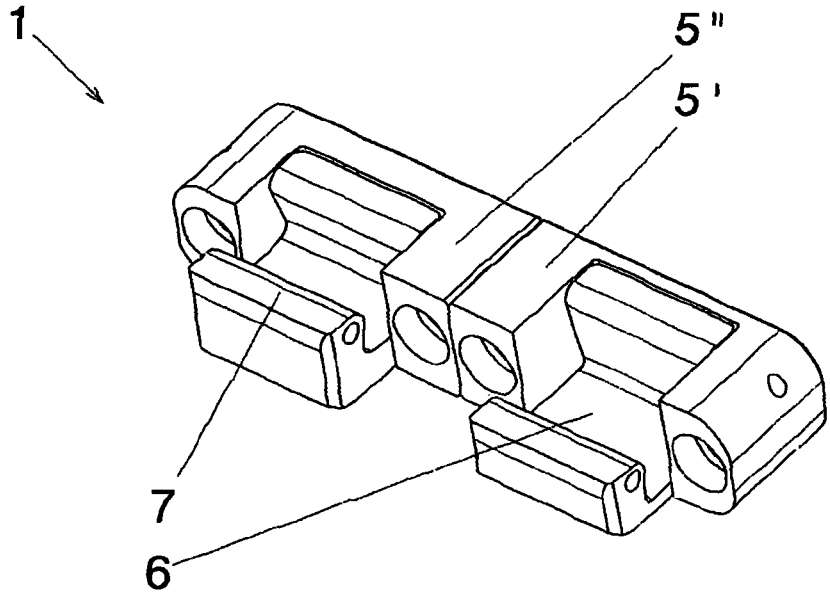

The embodiment including the stoppers X or the like on a hinge part 5, which has been described by means of FIG. 2*e* above, can also be seen in FIG. 3*e*, with the stoppers X or the like protruding into matching outlines on the hinge part 4 once the hinge 1 is fully opened out. Thereby, the surfaces of parts 2, 3 are aligned in a uniform, planar way. Of course, said stoppers X or formations may be designed in different ways, and it is also possible, for example, for one stopper X to be arranged on hinge part 5 and one stopper X to be arranged on hinge part 4, with corresponding matching outlines being arranged on both hinge parts 4, 5 opposite the stoppers X.

FIGS. 4*a* to 4*d* show a further embodiment of a 180° hinge according to the invention, wherein hinge parts 4 and 5 are formed as two parts in contrast to the embodiment in FIGS. 2*a* to 2*e*. According to this, two hinge parts 4', 4" are connected, possibly via an intermediate member 8, to a part 2, and two hinge parts 5', 5" are movably connected, possibly via another intermediate member 9, to the other part 3 via the at least two pivoting brackets 6, 7. Such modular construction makes it possible to equip the hinge 1 with two pivoting brackets 6, 7 according to the invention, or it may be designed according to a conventional construction by omitting hinge parts 4", 5" and pivoting bracket 7.

The hinge 1 according to the invention combines the advantages of known continuous and discontinuous hinges by combining at least two pivoting brackets 6, 7, with one pivoting bracket 7 transmitting static forces and the other pivoting bracket 6 ensuring forced guiding.

The invention claimed is:

1. A folding table, comprising:

first and second table parts each having an end face and a concealed 180° hinge movably connecting said table parts between a collapsed state, in which said table parts are disposed one on top of the other, and a fully opened-out state, in which said table parts are substantially aligned evenly next to one another, said end faces abut one another, and said table parts form a uniform surface of the table;

said hinge having:

a first hinge part attached at said end face of said first table part and a second hinge part attached at said second table part;

a first U-shaped pivoting bracket having ends pivotally connected to said first and second hinge parts about respective pivot axes, and at least one second U-shaped pivoting bracket having ends pivotally connected to said first and second hinge parts about respective pivot axes;

said pivot axes of said second pivoting bracket being offset from, and non-coaxial with, said pivot axes of said first pivoting bracket;

a plane defined by said pivot axes of said first and second pivoting brackets on said second hinge part extending substantially parallel to a plane of said second table part, and a plane defined by said pivot axes of said first and second pivoting brackets on said first hinge part extending substantially perpendicularly to a plane of said first table part; and wherein said hinge is substantially hidden in the opened-out state of the table.

2. The folding table according to claim 1, configured for installation in an airplane location with limited space.

3. The folding table according to claim 1, wherein said pivoting brackets are disposed one behind the other, in a direction of said pivot axes.

4. The folding table according to claim 1, wherein said hinge parts are formed with recesses for accommodating arms of said pivoting brackets, and each of said hinge parts is formed with two bores defining said pivot axes, with one bore being formed in each of said pivoting brackets, and wherein a pin is disposed to project through each of said bores.

5. The folding table according to claim 1, which comprises a stopper disposed on one hinge part and at least one outline matching said at least one stopper formed on the other said hinge part, wherein said stopper protrudes into said at least one outline when said hinge is fully opened out.

6. The folding table according to claim 1, which comprises at least one intermediate member for connecting to a respective said hinge part, said intermediate member being connected to one of said table parts.

7. The folding table according to claim 6, wherein said intermediate member is glued to said one table part.

8. The folding table according to claim 6, which comprises screws for connecting said hinge parts to said intermediate members.

9. The folding table according to claim 6, wherein said at least one intermediate member is made of aluminum or plastic.

10. The folding table according to claim 1, wherein said hinge parts are formed of multiple parts connected to one another.

11. The folding table according to claim 1, which comprises screws for connecting said hinge parts to said table parts.

12. The folding table according to claim 1, wherein one of said pivoting brackets is configured more stable for absorbing forces, while the other of said pivoting brackets for formed less stable for forced guiding.

13. The folding table according to claim 1, which comprises at least one spring element for supporting a movement of said hinge parts.

14. The folding table according to claim 1, wherein said hinge parts and said pivoting brackets are made of a material selected from the group consisting of steel, aluminum, and plastic.

15. A concealed 180° hinge for pivotally connecting two parts of a folding table for pivoting between a collapsed state, in which the two parts are disposed on top of one another, and a fully opened-out state, in which the two parts are substantially aligned next to one another and form a surface of the table, the hinge comprising:

first and second hinge parts for attachment to the two parts of the folding table;

first and second U-shaped pivoting brackets each having ends pivotally connected to said hinge parts about given pivot axes;

said pivot axes of said second pivoting bracket being offset from and non-coaxial with, said pivot axes of said first pivoting bracket, and said pivot axes being disposed such that a plane defined by said pivot axes of said two pivoting brackets at said first hinge part extends substantially parallel to a plane of the part of the folding table to be connected thereto, while a plane defined by said pivot axes of said two pivoting brackets at said second hinge part extends substantially perpendicular to a plane of the part of the folding table to be connected thereto, and wherein the hinge is adapted not to be visible in the opened-out state of the table.

16. The hinge according to claim 15, configured for a folding table in an airplane with limited space.

* * * * *